US005836733A

United States Patent [19]

Moses et al.

[11] Patent Number: 5,836,733

[45] **Date of Patent: *Nov. 17, 1998**

[54] MATERIAL-HANDLING VEHICLE

[75] Inventors: John Moses, Mickleover; John Pius Burke, Whitchurch, both of United Kingdom

[73] Assignee: J.C. Bamford Excavators Limited, Rocester, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 502,493

[22] Filed: Jul. 14, 1995

[30] Foreign Application Priority Data

| | | | |
|---|---|---|---|
| Jul. 15, 1994 | [GB] | United Kingdom | 9414382 |
| Aug. 1, 1994 | [GB] | United Kingdom | 9415506 |
| Mar. 23, 1996 | [GB] | United Kingdom | 9505963 |

[51] Int. Cl.[6] ..... E02F 5/22

[52] U.S. Cl. ..... 414/685; 180/298; 180/297; 414/718

[58] Field of Search ..... 180/297, 298; 414/680, 685, 686, 687

[56] References Cited

U.S. PATENT DOCUMENTS

| | | | |
|---|---|---|---|
| Re. 30,021 | 6/1979 | Olson et al. | 414/718 |
| 4,318,450 | 3/1982 | Griesenbrock | 180/298 |
| 4,393,607 | 7/1983 | Hirosawa | 414/687 |
| 4,449,606 | 5/1984 | Buschbam et al. | 180/297 |
| 5,348,516 | 9/1994 | Shibata | 180/297 |
| 5,463,915 | 11/1995 | Fuehrer et al. | 180/297 |
| 5,478,192 | 12/1995 | Bentivoglio | 414/718 |
| 5,687,809 | 11/1997 | Braud | 180/297 |

FOREIGN PATENT DOCUMENTS

| | | |
|---|---|---|
| 0 325 064 A1 | 7/1989 | European Pat. Off. . |
| 0375705 B1 | 11/1992 | European Pat. Off. . |
| 0 656 315 A1 | 6/1995 | European Pat. Off. . |
| 2 128 073 | 6/1971 | Germany . |
| 27 39 537 A1 | 9/1977 | Germany . |
| 2739325 A1 | 3/1978 | Germany . |
| 240869 A1 | 11/1986 | Germany . |
| 2 161 784 | 1/1986 | United Kingdom . |
| WO 89/00972 | 9/1989 | WIPO . |

OTHER PUBLICATIONS

The Liner Giraffe 2–25 Four–wheel drive site placing vehicle First and foremost in rough terrain materials handling.

*Primary Examiner*—Karen M. Young
*Assistant Examiner*—Gregory A. Morse
*Attorney, Agent, or Firm*—Marshall, O'Toole, Gerstein, Murray & Borun

[57] ABSTRACT

A material-handling vehicle comprising a structure having a ground engageable propulsion device, a loader arm, having a longitudinal axis, mounted at the rear of the structure for up and down swinging movement, an operator's cab disposed on the structure on one side of the loader arm longitudinal axis and an engine mounted on the structure to provide power for the swinging movement of the arm and propulsion of the vehicle, wherein the engine is located on one side of the loader arm longitudinal axis and the engine has an output shaft and the engine is transversely disposed with its output shaft transverse to the vehicle.

42 Claims, 14 Drawing Sheets

MATERIAL-HANDLING VEHICLE

BACKGROUND TO THE INVENTION

This invention relates to a material-handling vehicle of the kind, hereinafter referred to as the "kind specified", comprising a structure having ground engageable propulsion means, a loader arm mounted at the rear of the structure for up and down swinging movement, an operator's cab disposed on the structure on one side of the loader arm longitudinal axis and an engine mounted on the structure to provide power for said swinging movement of the arm and propulsion of the vehicle.

One such machine is disclosed in U.S. Re. 30,021. In this machine, which is relatively large, the loader arm is partly accommodated in a well provided between the cab and a load carrying platform disposed on the opposite side of the loader arm to the operator's cab. As a result the loader arm, in a fully lowered position, is disposed below a horizontal plane containing the top of a steering wheel in the operator's cab so that the driver's vision is substantially unobstructed. This vehicle is sufficiently large that an engine to provide power for swinging movement of the arm and propulsion of the vehicle can be accommodated beneath the well on the centre line of the vehicle.

EP-B-0375705 discloses another such vehicle in which the loader arm in a fully lowered position is partly accommodated in a well disposed between the operator's cab and a housing in which an engine to provide power for swinging movement of the loader arm and propulsion of the vehicle is disposed with the engine being arranged longitudinally of the vehicle so that the crank shaft of the engine extends parallel to the longitudinal axis of the vehicle. The loader arm is disposed below a horizontal plane containing the bottom of a side window in the operator's cab which faces transversely across the vehicle, again so as not to interfere with the view of the operator in this direction.

Such a vehicle configuration enables the vehicle to be made smaller than the vehicle of U.S. Re. 30-021 and enables the overall height of the vehicle to be reduced.

DE-A-2739537 discloses another such vehicle but in which the engine of the vehicle is disposed transversely, so that its crankshaft extends perpendicular to the longitudinal axis of the vehicle, and the loader arm, in its lowered position, is disposed so that the loader arm is entirely above the top of the engine and its associated housing. Accordingly the vehicle is unprovided with any well so that in a lowered position the loader arm extends alongside the operator's cab substantially above the bottom of a side window therein so that the driver's view transversely of the vehicle is obstructed.

All the above mentioned vehicles suffer from one or another disadvantage.

In U.S. Re. 30,021 because of the disposition of the engine underneath the loader arm the operator's cab is required to be relatively high so that the operator can still see over the top of the loader arm whilst providing sufficient space beneath the loader arm for the accommodation of the engine.

In DE-A-2739537 the driver's view transversely across the vehicle is obstructed because of the absence of a well to accommodate the loader arm, said absence being occasioned by the transverse disposition of the engine requiring space underneath the loader arm to accommodate the engine.

In EP-B-035705 access to the side of the engine adjacent to the cab is obstructed by the presence of the cab and the wheel base of the vehicle must be relatively large to accommodate the longitudinal extent of the engine between the wheels. A short wheelbase is desirable as it improves the manoeuvrability of the vehicle, which is important for operating in confined spaces.

An object of the invention is to provide a material-handling vehicle of the kind specified whereby the above mentioned problems are overcome or are reduced.

SUMMARY OF THE INVENTION

According to the present invention we provide a material-handling vehicle of the kind specified wherein the engine is located on one side of the loader arm longitudinal axis and the engine has an output shaft and the engine is transversely disposed with its output shaft transverse to the vehicle.

The loader arm may extend forwardly parallel to a vertical plane containing a longitudinal axis of the vehicle.

According to a first, more specific aspect of the invention the engine may be located on the opposite side of the loader arm longitudinal axis to the cab and the engine is spaced from the cab to define a well between the cab and the engine in which the arm, in a lowered position, can be at least partly accommodated.

The engine may be disposed on the opposite side of the loader arm longitudinal axis to the cab.

The engine may be disposed in a housing.

According to a second more specific aspect of the invention the engine may be located on the same side of the loader arm to the cab with the engine disposed at least partly beneath the cab.

A housing may be provided, disposed on the opposite side of the loader arm to the cab, and a well may be provided, between the cab and the housing, in which the arm, in a lowered position, can be at least partly accommodated.

The housing may house a cooling means for the engine or other auxiliary means of the engine and/or vehicle such as a fuel or oil tank.

The first and/or the second more specific aspects of the invention may have the following features.

The output shaft of the engine may be perpendicular to the longitudinal axis of the vehicle. However, if desired, the output shaft of the engine may be arranged at an angle other than perpendicular to the longitudinal axis of the vehicle.

For example, it is envisaged that it may be convenient for the output shaft to be at an angle in the range 35°–55° to the longitudinal axis of the vehicle and preferably at 45° to the longitudinal axis.

Where the engine is a reciprocatory piston engine the output shaft may be provided by the crankshaft of the engine.

The structure may have a front end and a rear end with said longitudinal axis of the vehicle extending therebetween and the ground engageable propulsion means being disposed equi-distant from, and on opposite sides of, said longitudinal axis.

The loader arm may carry a material handling implement at its front end so that the material handling implement is disposed in front of the front of the structure when the arm is in its lowermost position.

The cab may have a side window which faces transversely across the vehicle at right angles to the longitudinal axis of the vehicle.

The loader arm may be mounted on the structure at a position which is not more than a predetermined distance above a horizontal plane passing through the highest part of the engine or the engine.

By "a first predetermined distance" we mean about 350 mm above and preferably about 300 mm above or at or below the height of said highest point.

The loader arm, at the position alongside the highest point of the engine, may be not more than a second predetermined distance above said horizontal plane.

By "a second predetermined distance" we mean about 450 mm above and preferably about 65 mm above and may be at or below the height of said highest point.

The structure may comprise a pair of spaced fore and aft extending frame members which are preferably parallel to each other.

The ground engageable propulsion means may be driven via a mechanical transmission.

The mechanical transmission may comprise a gearbox disposed underneath the well.

The gearbox may have an input shaft which extends generally parallel to the longitudinal axis of the vehicle and at least one output shaft which also extends generally parallel to the longitudinal axis of the vehicle and there being a transfer mechanism having an input shaft to transfer the drive from the transversely extending output shaft of the engine to the longitudinally extending input shaft to the gearbox.

The transfer mechanism may comprise an input shaft and an output shaft disposed at an angle to each other, the input shaft being connected to the output shaft of the engine and the output shaft being connected to the input shaft to the gearbox and the input and output shafts of the transfer mechanism being connectable in torque transmitting relationship by a gear set which may comprise a bevel gear set.

Where the output shaft of the engine is inclined to the longitudinal axis of the vehicle, the input shaft of the transfer mechanism is inclined to the output shaft of the transfer mechanism at a corresponding angle.

Where the output shaft of the engine lies at 90° to the longitudinal axis of the vehicle, the input shaft of the transfer mechanism may be arranged at 90° to the output shaft of the transfer mechanism.

Where the output shaft of the engine lies at 45° to the longitudinal axis of the vehicle, the input shaft of the transfer mechanism may be arranged at 45° to the output shaft of the transfer mechanism, or at another appropriate angle depending on the angle of the output shaft of the engine to the longitudinal axis of the vehicle.

The ground engageable propulsion means may comprise a pair of ground engageable wheels disposed adjacent the front of the structure and a pair of rear ground engageable wheels adjacent the rear of the structure.

The wheels of the front pair may be driven from a first output shaft of the gearbox whilst the wheels of the rear pair may be driven by a second output shaft of the gearbox through differential gear means.

The transfer mechanism may be provided with damping means between the engine output shaft and the transfer mechanism input shaft to reduce engine induced vibrations or resonance.

The engine and/or transfer mechanism and/or gearbox may be provided with mounting means to accommodate torsional movement and as necessary lateral, axial, vertical movement of both engine and gearbox.

The engine, transfer mechanism and gear box may be rigidly connected together.

Preferably the transfer mechanism comprises a housing having a first mounting face, which faces transversely outwardly of the vehicle, to which a mounting face of the engine is connected, and a second mounting face facing in the fore and aft direction of the vehicle, to which a mounting face of the gear box is connected.

The engine, transfer mechanism and gear box may each have at least one mounting means whereby the coupled together components are mounted on the vehicle. Preferably the mounting means are vibration isolating mountings.

The housing of the transfer mechanism may have a first and a second mounting means disposed on opposite sides of the axis of rotation of the output shaft of the engine and preferably carried by one of the fore and aft extending frame members.

The gear box may have a mounting on the side of the gear box which is on the opposite side of the fore and aft axis of the vehicle to the engine and preferably carried by the other of the fore and aft extending frame members.

Alternatively, at least one of the engine and the gearbox may be movable relative to the transfer mechanism and the engine output shaft being flexibly connected to in input shaft of the transfer mechanism and/or the output shaft of the transfer mechanism being flexibly connected to the input shaft of the gearbox.

The vehicle according to the present invention may be provided with a relatively short wheel base because of the relatively short longitudinal extent of the transversely mounted engine permitting the wheels to be closer together than as hitherto have been provided. The provision of a mechanical transmission is less costly than a hydrostatic transmission.

BRIEF DESCRIPTION OF THE DRAWINGS

The invention will now be described by way of example with reference to the accompanying drawings in which.

DESCRIPTION OF THE PREFERRED EMBODIMENTS

Figure 1:
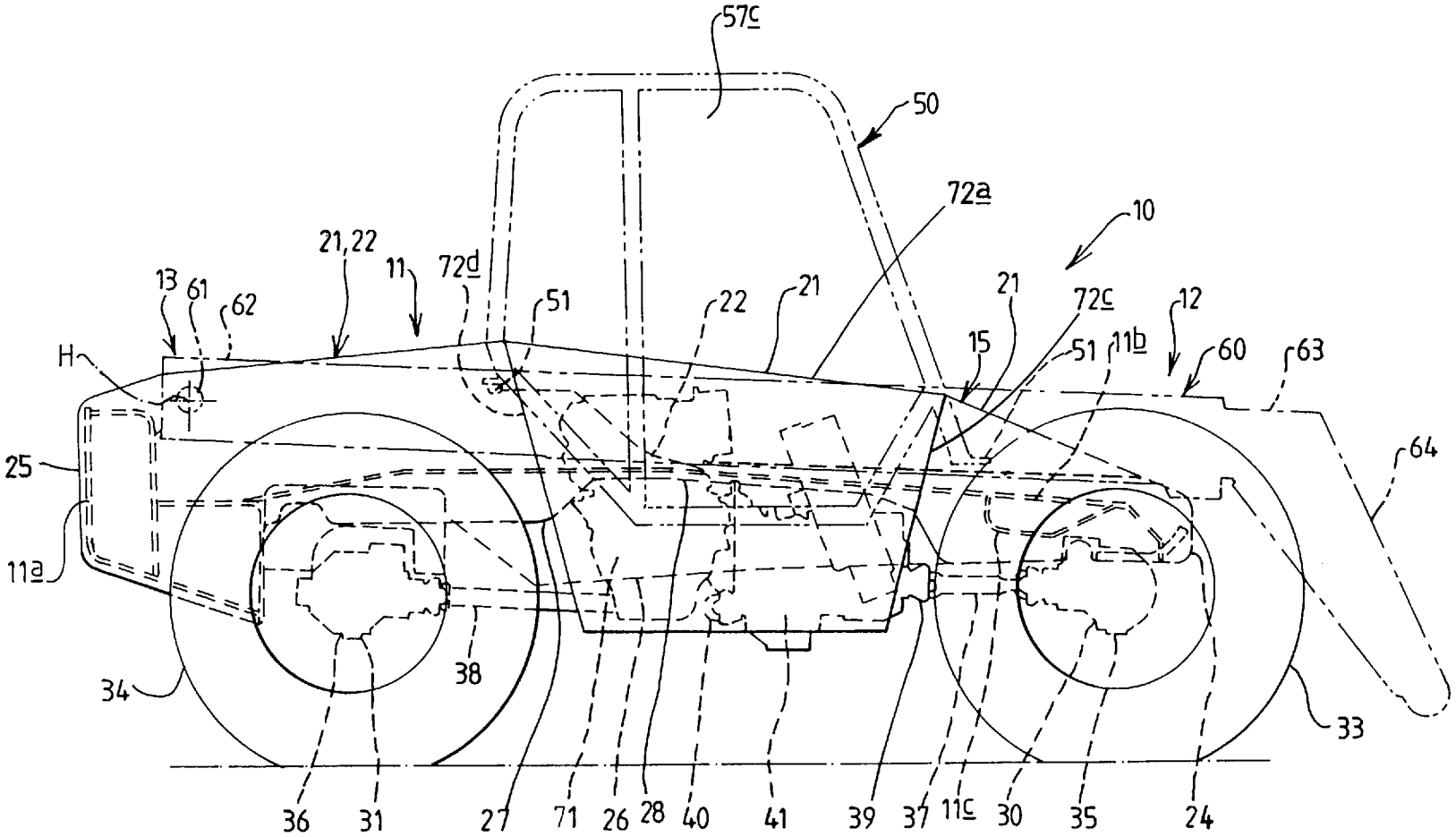
FIG. 1 is a side elevation of a material-handling vehicle embodying the invention.

Referring to FIGS. 1 to 6 of the drawings, a material-handling vehicle is indicated generally at 10 and comprises a main structure 11 having a front end 12 and a rear end 13 with a longitudinal axis X-X extending between the front and rear ends. The structure 11 comprises a pair of spaced parallel frame members 14, 15 held in spaced parallel relationship by cross members including a rear torsion box 11*a*, a deck plate 11*b* and front torsion box 11*c*.

Each frame member 14, 15 has an upper surface 21, 22 respectively. At the front and rear the frame members 14, 15 have generally upright parts 24, 25 respectively whilst on their undersides they have a lower surface 26, 27 respectively. The right-hand frame member 15 has an upwardly relieved part 28 to provide clearance for an engine and transfer mechanism, as hereinafter to be described. A front axle 30 is mounted on the frame members 14, 15 at the front end thereof whilst a rear axle 31 is mounted to the frame members 14, 15 towards the rear thereof. The axles 30, 31 are of conventional type carrying at their opposite ends front wheels 33 and rear wheels 34 respectively. Both the front wheels 33 and both rear wheels 34 are pivotable relative to their associated axis about a vertical steering axis V for steering movement of the vehicle, as shown in chain dotted line in FIG. 3. If desired, at least one of the axles may be mounted relative to the frame members 14, 15 for oscillation about a longitudinally extending axis. Each axle 30, 31 is provided with a differential 35, 36 respectively of conventional form, the differentials being driven by propeller shafts 37, 38 respectively from front and rear output shafts 39, 40 respectively of a change speed gearbox 41 incorporating, by virtue of being bolted thereto, a torque converter 42. The input and output shafts and change speed gear carrying shafts of the gear box 41 extend parallel to the longitudinal axis X-X. If desired the torque connector may be omitted or provided in some other suitable manner in the drive train.

The change speed gearbox 41 is mounted on the frame members 14, 15 so as to be disposed therebetween and disposed so that the rear end face 41*a* of the gearbox is at a position approximately midway between transverse axes $R_F$, $R_R$ respectively extending horizontally through the axes V and the centre of propulsive rotation of each wheel 33, 34.

An operator's cab 50 is mounted on the frame member 14 by vibration isolating mounts 51 so that the cab 50 is supported on one side of the longitudinal axis X-X of the vehicle. The cab 50 has a front window 57*a*, a rear window 57*b* and two side windows 57*c*, 57*d*, the window 57*c* facing transversely across the machine. The or each window may be provided with a transparent closure element such as glass, or may be open, or may be provided with a protective element such as a grille or barts. A driver's seat, steering wheel and other controls, not shown, are provided in the cab and the cab is provided with an access door or opening on the side in which the window 57*d* is provided.

A loader arm 60 is pivotally mounted, by means of an axle member 61, between the frame members 14, 15 at the rear 13 of the vehicle for pivotal up and down swinging movement about a horizontal axis H. The loader arm 60 is telescopic and comprises a rear outer section 62 which is pivotally connected to the frame members 14 and 15 by the axle 61 and a forward inner member 63 which is telescopically slidable within the section 62 under the control of hydraulic rams in conventional manner. At its front end the part 63 is provided with a downwardly and forwardly extending part 64 adapted to carry a material handling implement such as a loader bucket or lifting forks or other desired material handling means. If desired the loader arm may have more than two telescopically slidable sections or may not be telescopic.

When the loader arm 60 is in its lowermost position, as shown in the Figures, it lies in a well 70 of a minimum width W which is greater than the width of the loader arm and provided between the cab 50 and the frame member 15.

An internal combustion engine 71 is disposed on the opposite side of the frame member 15 to the well 70 and thus is disposed on the opposite side of the longitudinal axis X-X of the vehicle to the cab 50. The engine 71 is, in the present example, a four cylinder diesel engine having a crankshaft 71*c* rotatable about an axis C-C which is perpendicular to the longitudinal axis X-X. The engine 71 is mounted on the frame member 15 by means of a mounting frame 74 carried by the frame members 14, 15 and having a transversely outwardly extending part 75 supported in cantilever from the frames 14, 15. The frame 74 carries vibration isolating mounts 76 by which the engine 71 is mounted on the vehicle and further vibration isolating mounts 76*a* by which the gear box 41 is mounted on the vehicle.

Figure 2:
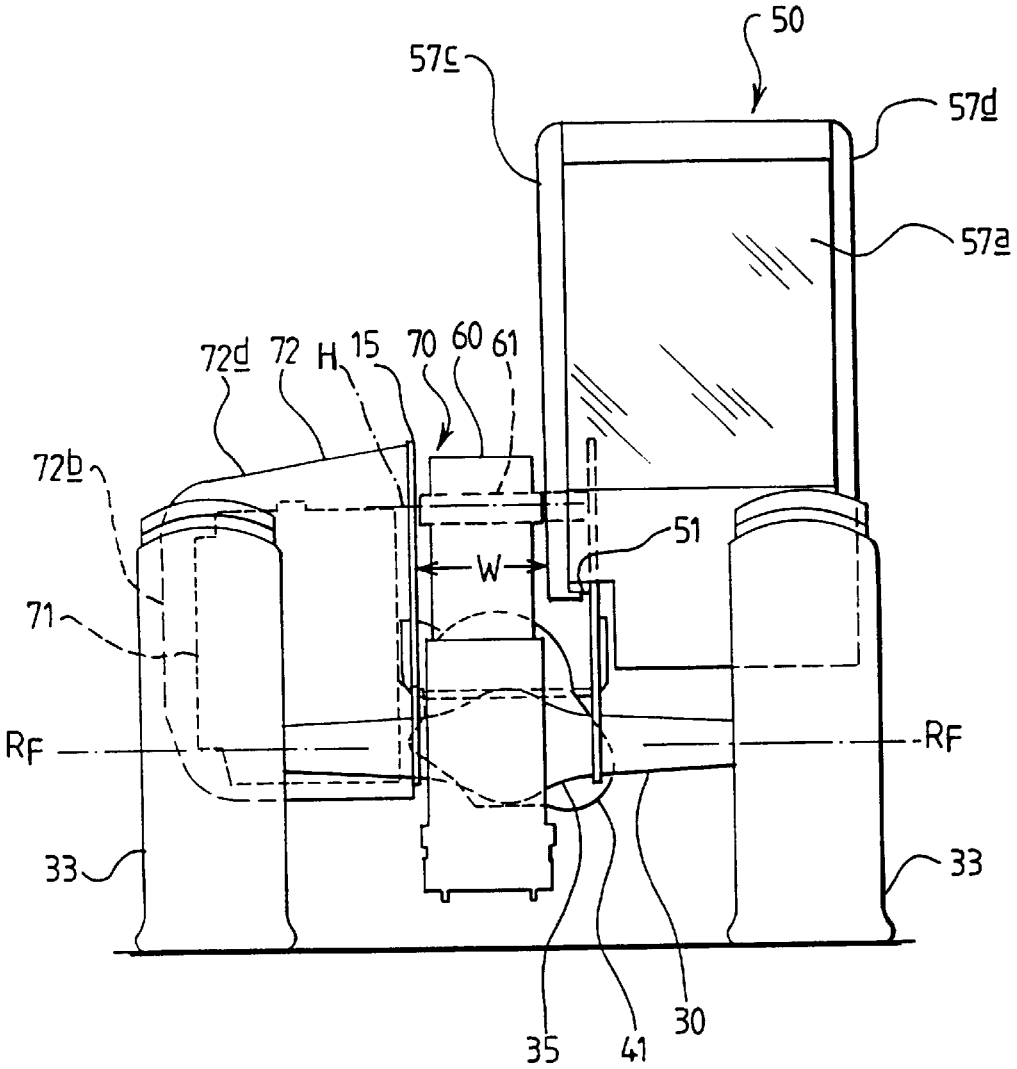
FIG. 2 is a front elevation of the machine of FIG. 1.

The engine is disposed in a housing 72, the top 72*a* of which at one side extends generally transversely away from the frame member 15 at substantially the top thereof and is inclined downwardly, as best shown in FIG. 2. At the outer edge the housing 72 has a generally vertical side surface 72*b* and, at the front and rear, downwardly and rearwardly and downwardly and extending forwardly front and rear end faces 72*c*, 72*d* respectively. If desired, the housing may be of a different configuration than that described hereinbefore and may be wholly or partly omitted.

Figure 4:
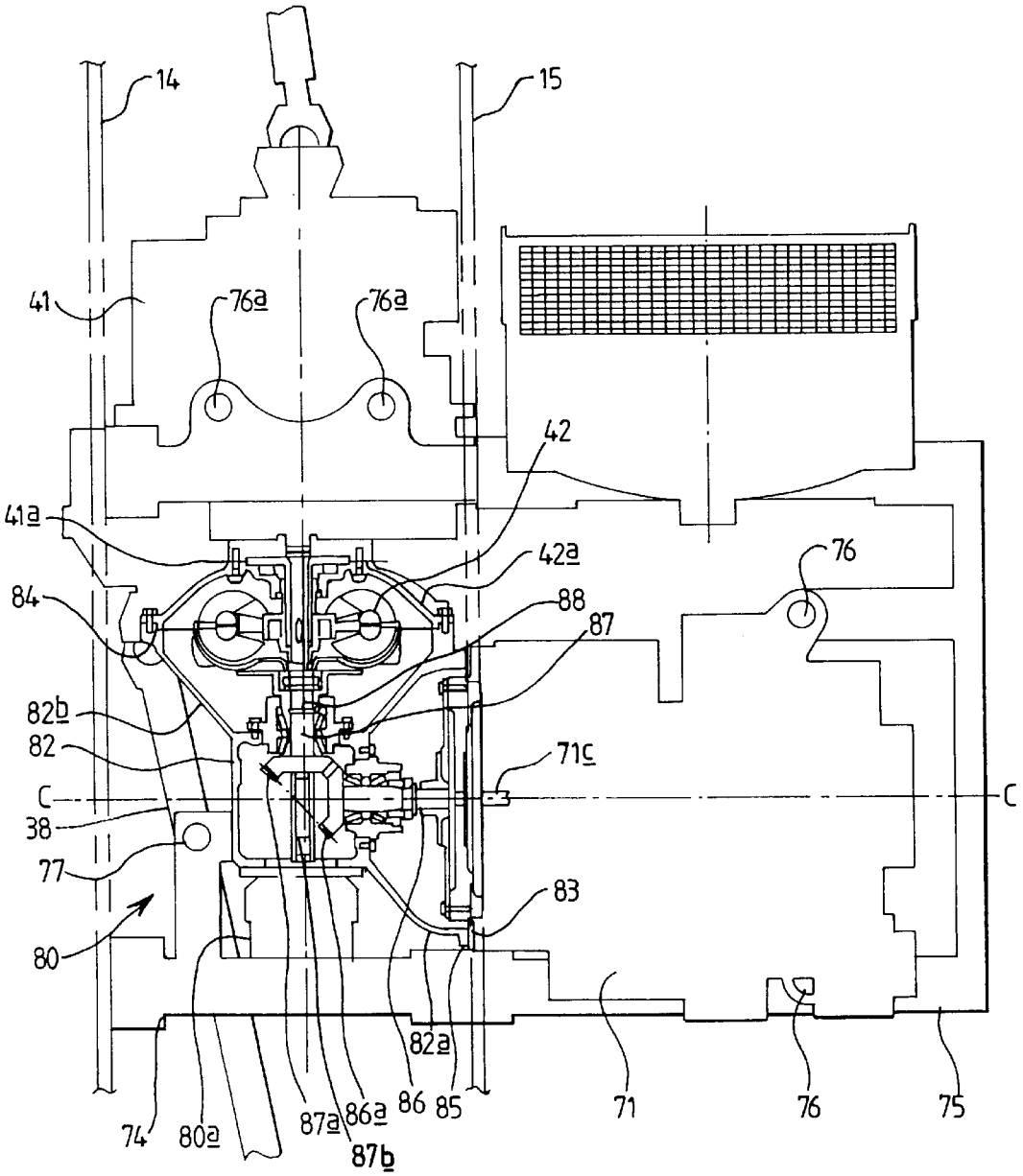
FIG. 4 shows part of FIG. 3 drawn to an enlarged scale.

Disposed between the engine 71 and the gearbox 41 is a transfer mechanism 80 mounted in a transfer box 82 having a first extension part 82*a* having a first mounting face 83 bolted to the inwardly facing end face 85 of the engine 71 and a second extension part 82*b* having a second mounting face 84 bolted to a first torque converter housing part 42*a* which is bolted to the rearwardly facing end 41*a* of the gearbox 41. Rotatably mounted within the transfer box 82, as best shown in FIG. 4, is an input shaft 86 which is connected to the crankshaft 71*c* of the engine and an output shaft 87 which is connected to the input shaft 88 of the gearbox. The input and output shafts 86, 87 have bevel gears 86*a*, 87*a* respectively fixed relative thereto and which are interengaged to transmit torque between the engine and the gearbox therethrough. The output shaft 87 has an extension 87*b* which drives a hydraulic pump 80*a* bolted to the transfer box 82.

Although in this example the torque converter 42 is housed by virtue of the transfer box 82 having an integral extension part 82*b* which provides a second torque converter housing part and which co-operates with the first torque converter housing part 42*a* to provide a housing for the torque converter 42, if desired the torque converter housing part 82*b* may be separate from and bolted to the transfer box 82. Moreover, the torque converter may be housed in any other desired manner so as to be operatively disposed between the gearbox and the transfer mechanism or at another suitable disposition in the drive path such as between the engine and the transfer mechanism.

The transfer box 82 is connected to the mounting frame by a vibration isolating mount 77 but if desired the transfer box may be supported solely by virtue of its connection to the engine and the gearbox.

If desired, other forms of mechanical transfer means may be provided to transfer the drive between the engine and the gearbox.

Disposed in front of the engine within the housing 72 is a cooling radiator 90 through which coolant of the engine 71 is circulated through pipes, not shown, and the radiator 90 is provided with an hydraulically operated fan 91, or, if desired, by an electrically or mechanically operated fan to cause flow of cooling air of the radiator, suitable ventilation openings may be provided in the housing 72 for flow of such air. If desired the radiator may be positioned at another position on the vehicle, such as adjacent to the rear thereof.

Although in the above described example the engine is disposed wholly to the rear of a mid-point between the axes $R_F$ and $R_R$ and the gearbox substantially wholly to the front of such mid-point, is desired the engine may be positioned in any desired longitudinal position between the wheels and the gearbox may be positioned at a desired longitudinal position on the machine. If desired, the gearbox may be mounted to the rear of the engine.

The distance between the outside of frame members 14, 15 may be less than 30% of the overall width of the machine excluding the wheels and may be, for example, in the range 24% to 27%.

The axis H lies in the same horizontal plane as the highest point of the engine 71, i.e. the rocker box in the illustrated example, but may be below this height or above this height, for example, about 300 mm above or even higher, such as 350 mm above.

The highest point of the loader arm 60, including any external component such as an operating ram, at the position alongside the highest point of the engine is about 65 mm above the highest point of the engine but may be at or below the highest point or above this height, for example 400 mm above or higher, such as 450 mm above.

The arm in its lowest position may be horizontal or may extend forwardly and downwardly.

Figure 3:
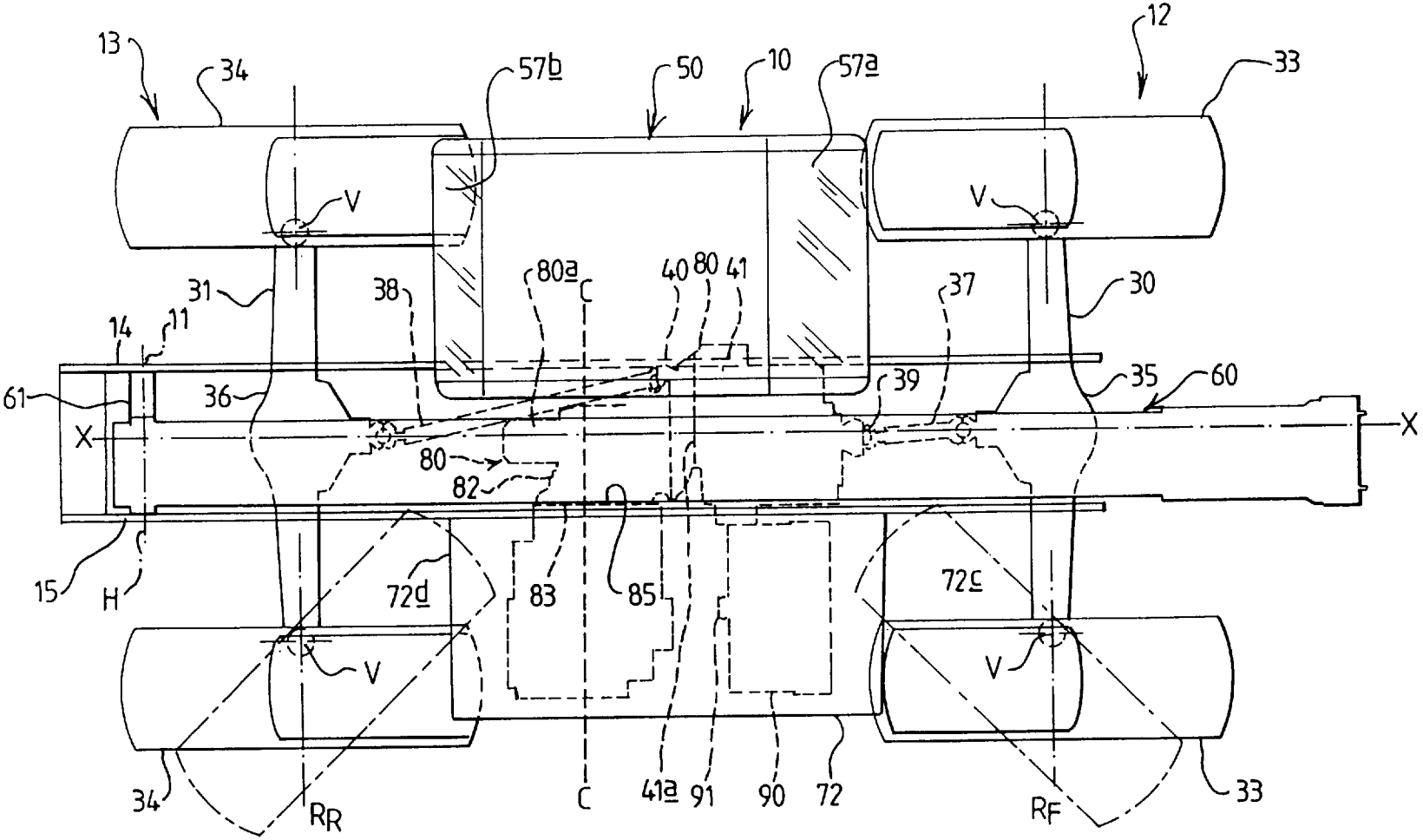
FIG. 3 is a plan view of the vehicle of FIG. 1.
Figure 5:
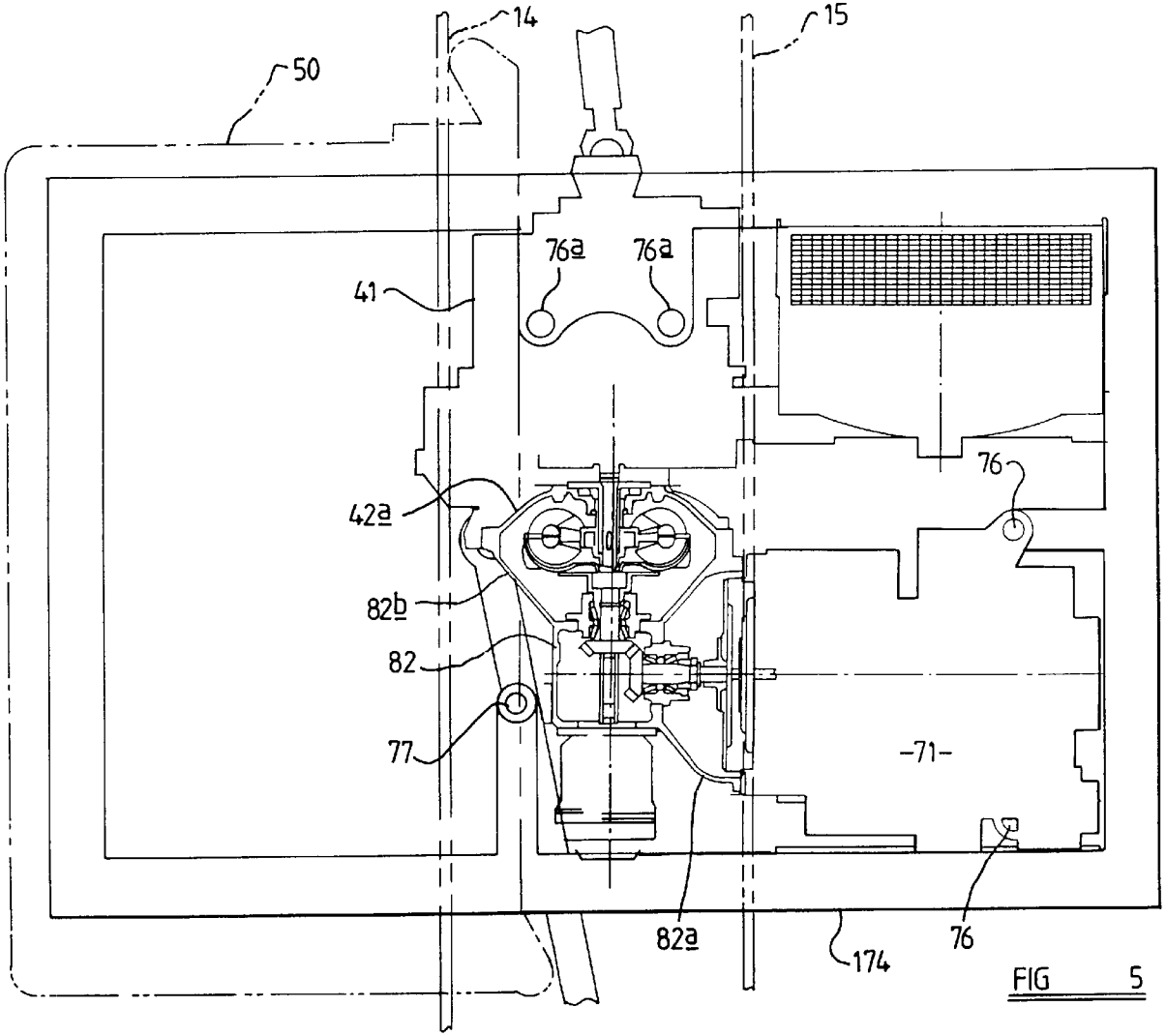
FIG. 5 is a plan view, similar to that of FIG. 4, but of a modification of the vehicle shown in FIGS. 1 to 4.

Referring now to FIG. 5, in which the same reference numerals have been used to refer to corresponding parts as were used in FIGS. 1 to 4, this illustrates a modification of the vehicle described with reference to FIGS. 1 to 4 in which the vehicle is provided with a mounting frame 174 which extends in cantilever from the frame members 14 and 15 on opposite sides thereof so that the frame carries the engine on the outside of the frame 15 and carries the cab 50 on the outside of the frame 14. In other respects the modification of FIG. 3 is as described previously.

Figure 6:
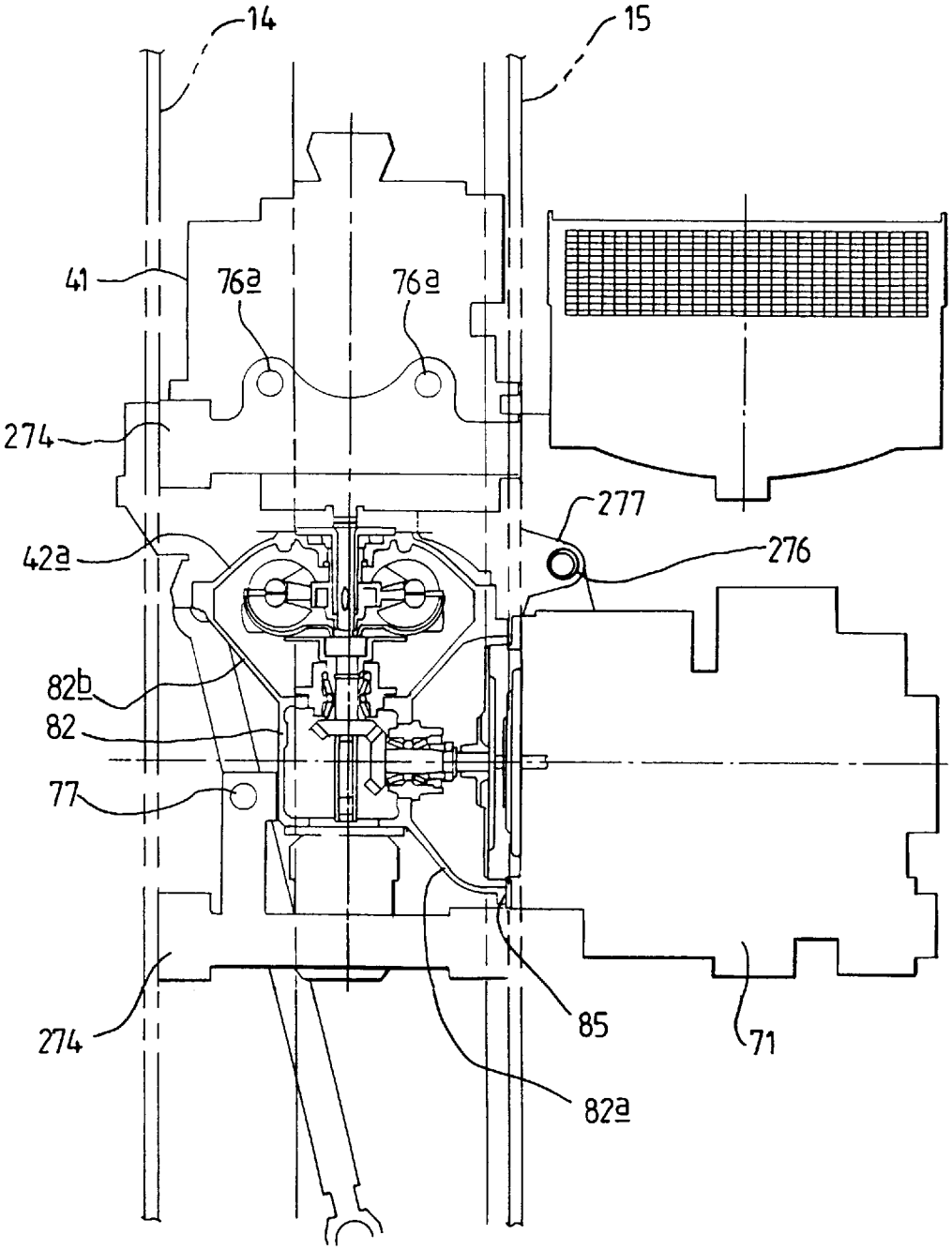
FIG. 6 is a plan view, similar to that of FIG. 4, of another modification of the vehicle shown in FIGS. 1 to 4.

FIG. 6, in which the same reference numerals have been used to refer to corresponding parts as were used in FIGS. 1–4, shows an alternative modification in which the gearbox and transfer box are supported as described hereinbefore from a mounting frame 274 which is disposed, in this case, substantially wholly between the frame members 14, 15 and the engine is supported in cantilever by virtue of the inwardly facing end mounting face 85 of the engine, being bolted to the first mounting face 83 of the transfer box 82 with one or more vibration isolating mounts or other torsion control means 276 being provided between the engine and the side frame 15 or a lug 277 provided on the frame 274.

Figure 7:
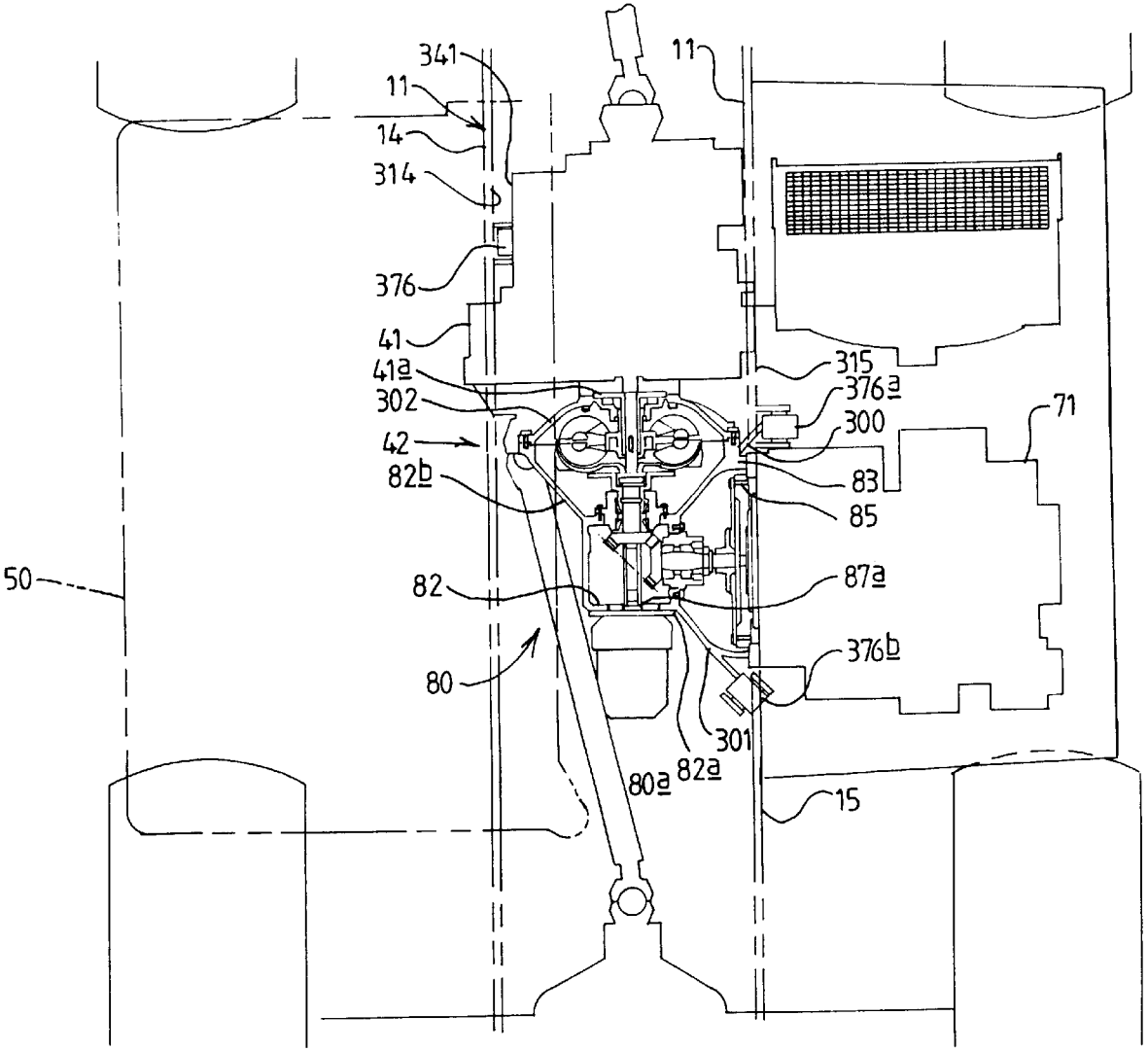
FIG. 7 is a plan view similar to that of FIG. 4 but of a further, preferred, modification of the vehicle shown in FIGS. 1 to 4.
Figure 8:
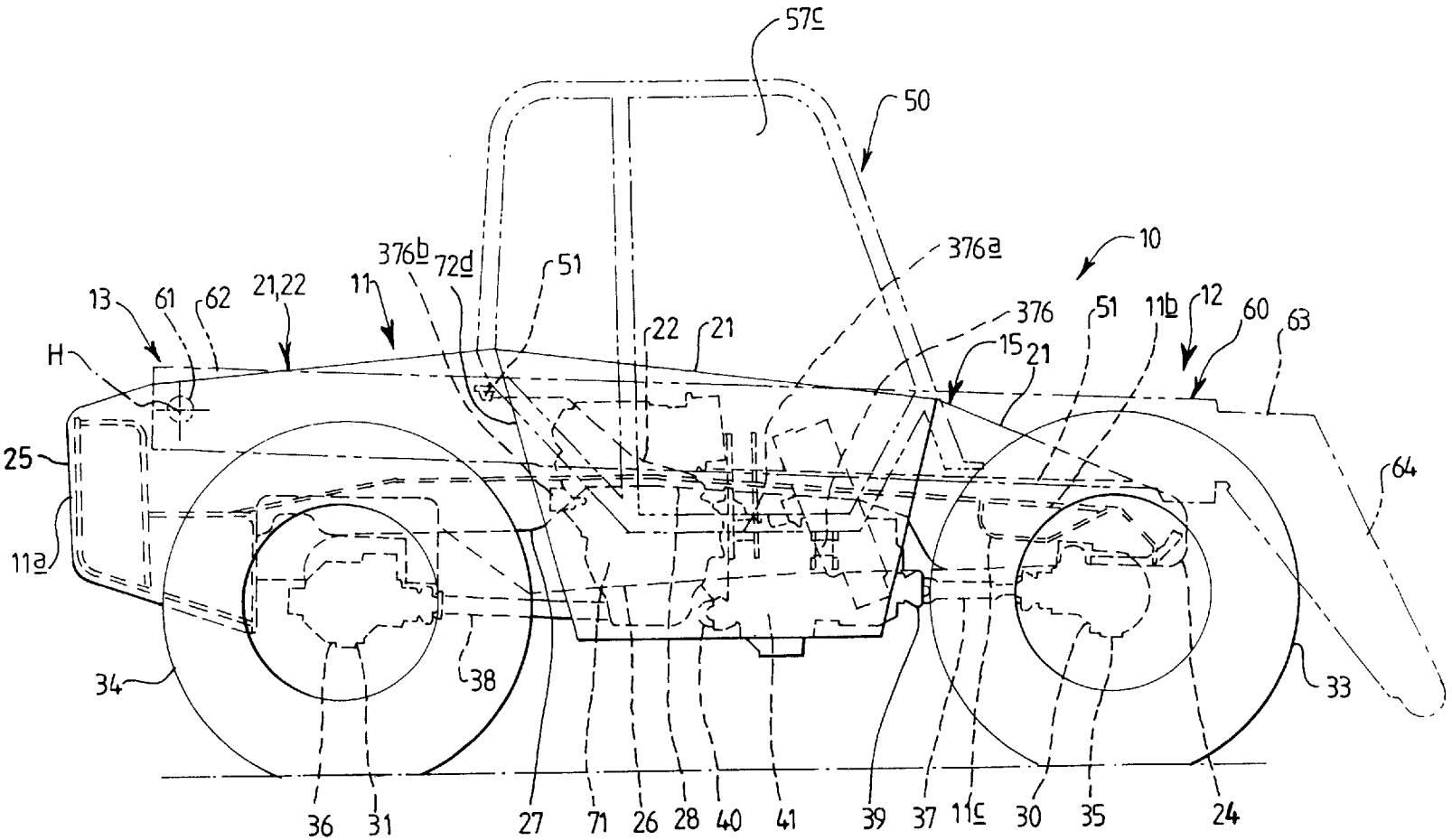
FIG. 8 is a side elevation of the modification shown in FIG. 7.

FIGS. 7 and 8, in which the same reference numerals have been used to refer to corresponding parts as were used in FIGS. 1–4, show a further, preferred, modification in which a drive assembly comprising the engine 71, transfer mechanism 82 and a gear-box 41, is mounted using three mounts on the main structure 11. The gearbox 41 is mounted relative to the frame member 14 by a conventional vibration isolating mount 376 disposed between the inwardly facing surface 314 of the frame member 14 and the adjacent surface 341 of the gearbox 41. A second mount 376*a* is provided between the outwardly facing surface 315 of the other frame member 15 and a lug 300 formed integrally with the extension part 82*a* of the transfer box 82.

A third mount 376*b* is provided between the frame member 15 and a lug 301 formed integrally with the first extension part 82*a* of the transfer box 82 and disposed on the opposite side of the axis of rotation of the output shaft of the engine to the mount 376*a*.

The engine is supported in cantilever as described in connection with FIG. 6 by virtue of an inwardly facing mounting face 85 of the engine being connected to the first mounting face 83 of the transfer box 82.

In the specific examples described with reference to FIGS. 1 to 7 of the drawings, the engine 71 is so arranged that its output shaft 71*c* is transverse to the longitudinal axis X-X of the vehicle and the axis of rotation of the output shaft 71*c* is inclined at, or substantially at, 90° to the axis X-X.

However, in another arrangement, if desired, the axis of rotation of the output shaft of the engine may be arranged transverse to the axis X-X at an angle other than perpendicular to the longitudinal axis.

For example, it is envisaged that it may be convenient for the axis of rotation of the output shaft to be at 45° to the longitudinal axis or at least in the range 35°–55°.

Figure 9:
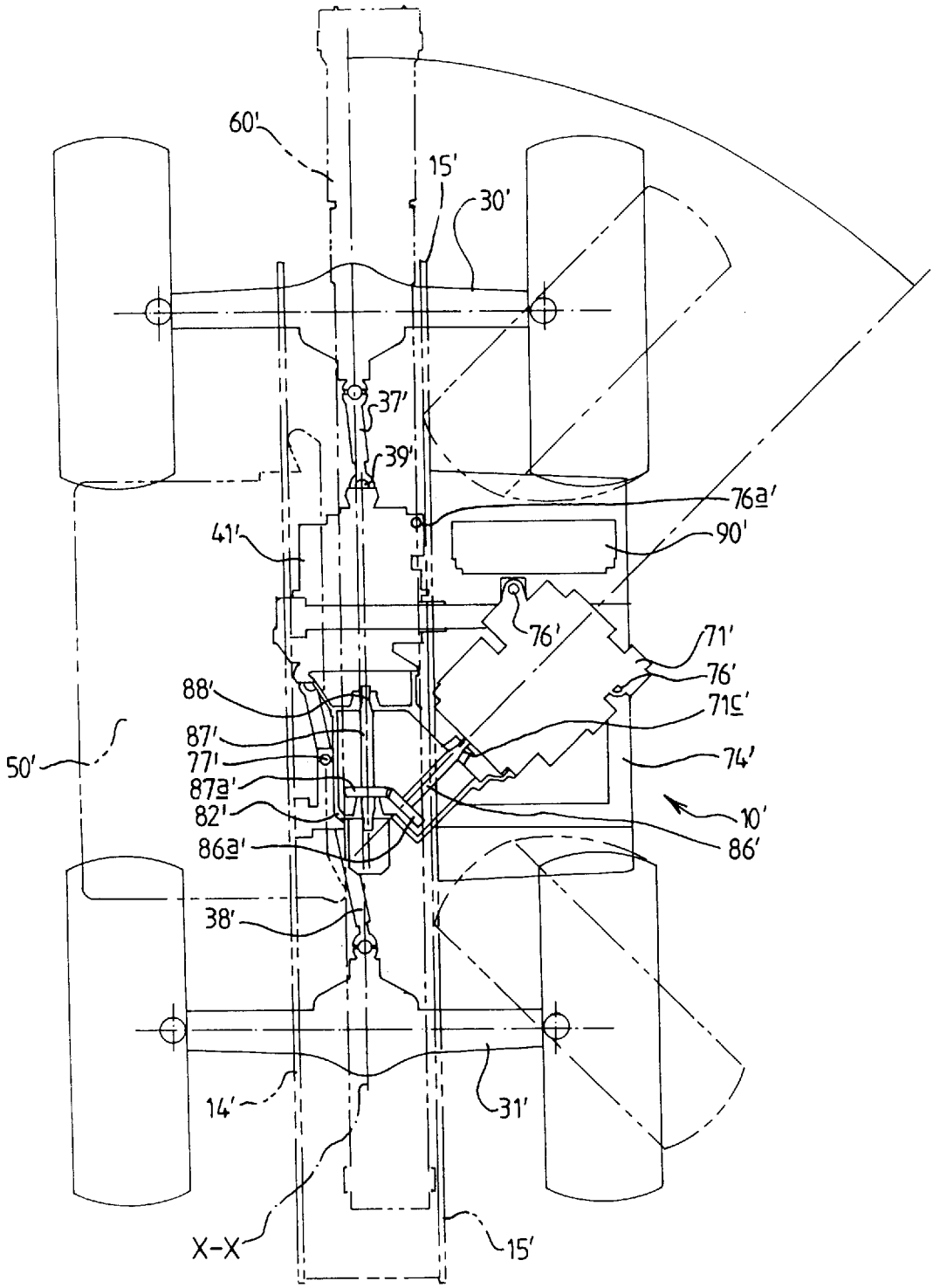
FIG. 9 is a plan view, with parts omitted for clarity, of an alternative vehicle embodying the invention.

In FIG. 9 there is shown a vehicle 10' which is in most respects, is generally similar to the vehicle 10 of FIGS. 1 to 8. Similar parts are labelled with the same reference numerals but with a prime sign added.

In FIG. 9, the engine 71' is mounted transversely but so that its output shaft 71*c'* extends generally at 45° to the longitudinal axis X-X of the vehicle 10'.

The transfer box indicated at 82' includes an input shaft 86' which also extends generally at 45° to the longitudinal axis X-X of the vehicle, and the transfer box 82' further comprises an output shaft 87' which extends generally parallel to the axis X-X, and connects with the input shaft 88' of change speed gearbox 41'.

The input and output shafts 86', 87' of the transfer box 82' each have respective bevel gears 86*a'* and 87*a'* and thus drive can be transmitted from the output shaft 71*c'* of the engine 71' to the change speed gearbox 41'.

In this embodiment, the cooling radiator indicated at 90' is mounted adjacent to the engine 71' towards the front end of the vehicle 10' and the engine 71' is mounted on a mounting frame 74' by means of vibration isolating mounts 76'. The gear box 41' is mounted by means of a vibration isolating mount 76*a'* on the frame member 15' and the transfer box 82' by a vibration isolating mount 77' on the mounting frame 74'.

In the FIG. 9 arrangement, the Output shaft 71*c'* of the engine 71' subtends an angle of about 45° to the longitudinal axis X-X, the output shaft 71*c'* extending towards the rear axle 31' of the vehicle 10'.

Figure 10:
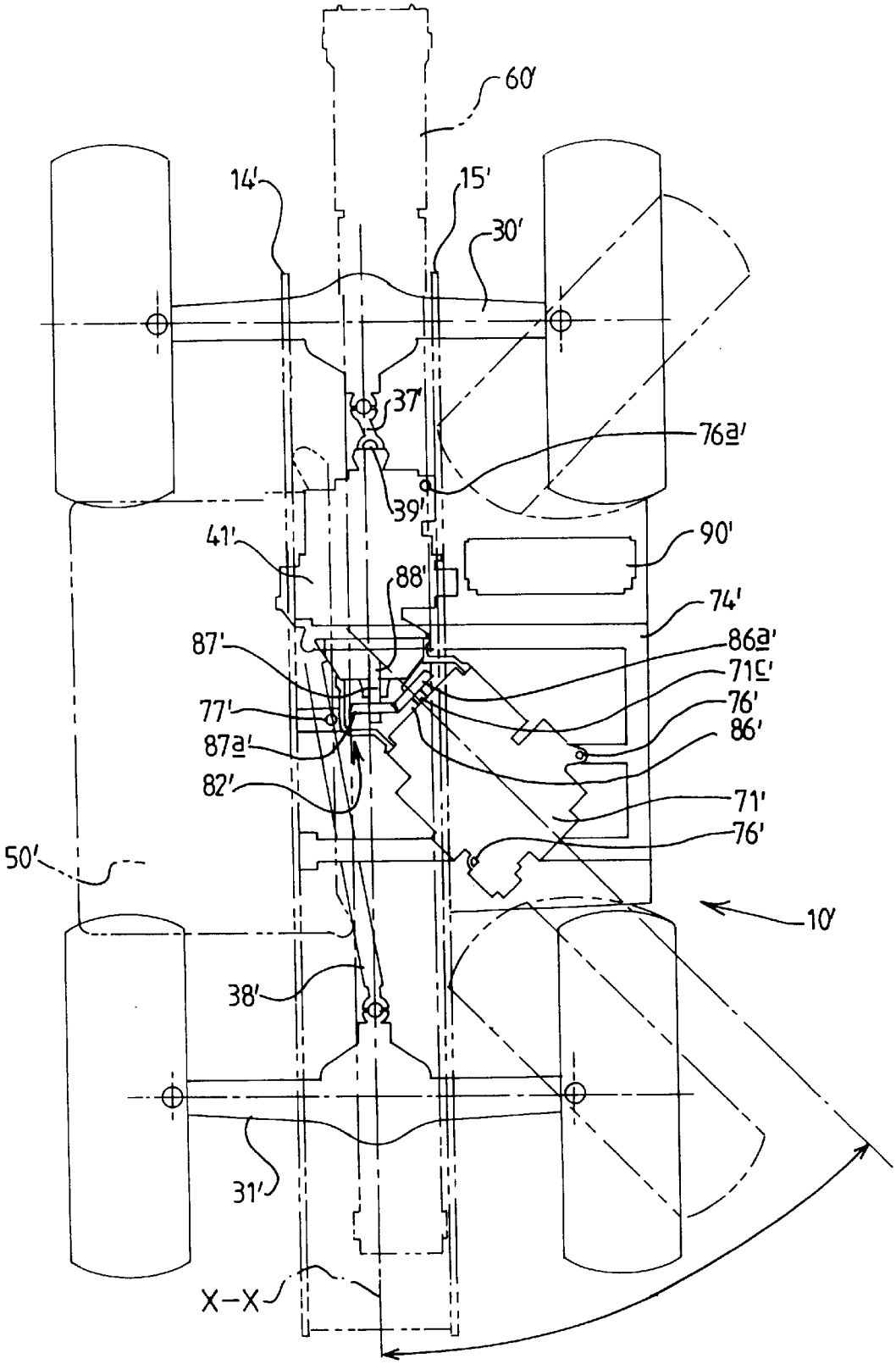
FIG. 10 is a plan view, with parts omitted for clarity, of another alternative embodying the invention.

In FIG. 10, a substantially identical vehicle to vehicle 10' of FIG. 9 is shown with corresponding parts being given the same reference numerals.

In the FIG. 10 arrangement, the output shaft 71*c'* of the vehicle subtends an angle of about 45° to the longitudinal axis X-X of the vehicle, but the output shaft 71*c'* extends towards the front axle 30' of the vehicle. In this arrangement, bevel gears 86*a'* and 87*a'* of the transfer mechanism 82' are arranged oppositely to the corresponding gears of the mechanism 82' in FIG. 9. Also, the change speed gearbox 41' in FIG. 10 is arranged slightly forward in the vehicle compared with the gearbox 41' of the vehicle shown in FIG. 9.

The vibration isolation mounts 76' for the engine 71' are arranged as shown, as are the mounts 76*a'* and 77' for the gear box 41' and transfer box 82' respectively; the mounting 77' being carried on a bracket on the frame member 14'.

Figure 11:
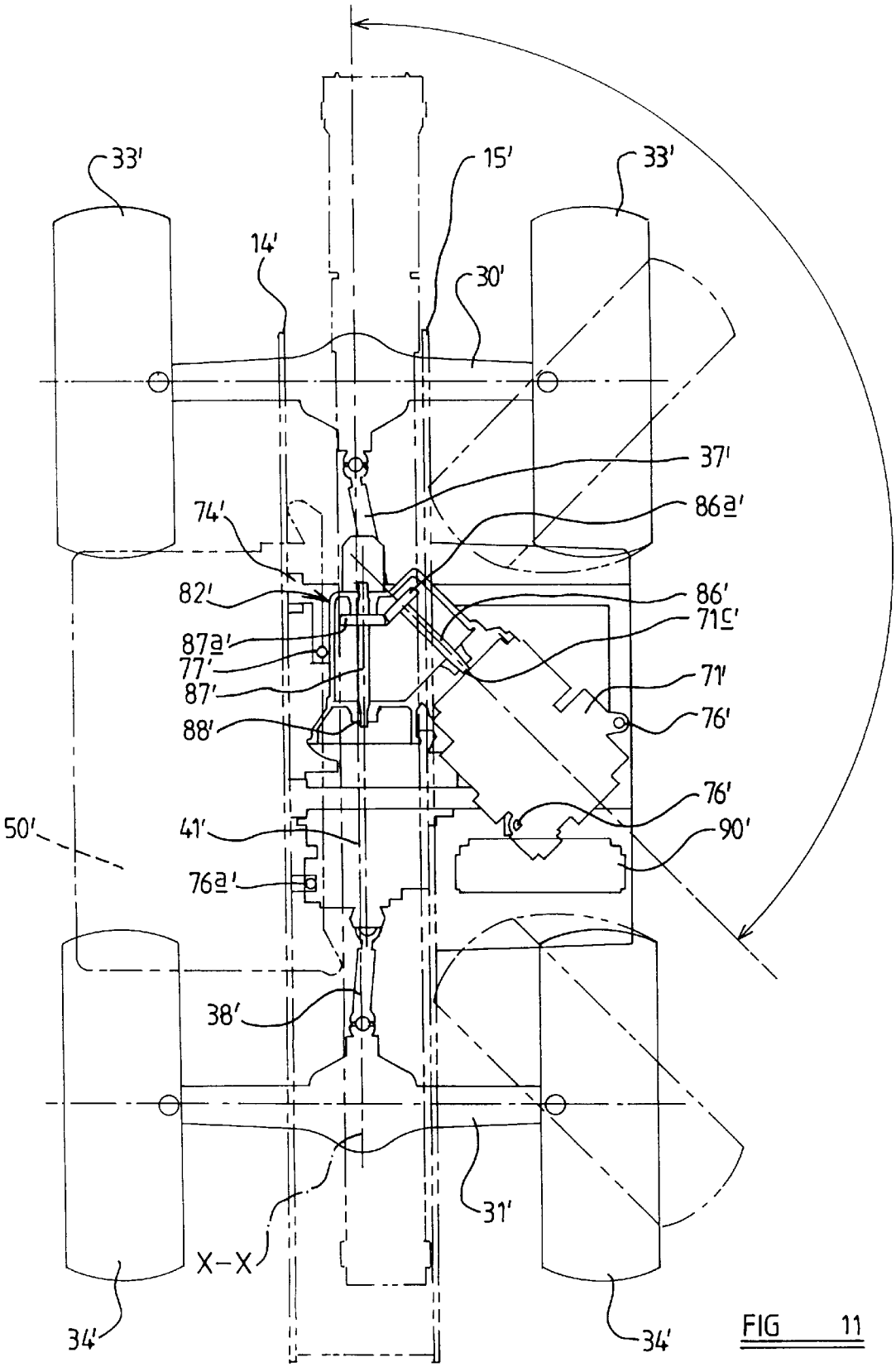
FIG. 11 is a plan view, with parts omitted for clarity, of another alternative embodying the invention.

The vehicle 10' shown in FIG. 11 is generally identical to the vehicles in FIGS. 9 and 10 and corresponding parts are again labelled with the same reference numbers. However, in the vehicle of FIG. 11 the output shaft 71*c*' of the engine 71' is arranged similarly to the output shaft of the engine of the vehicle 10' of FIG. 9 i.e. towards the front axle 30' of the vehicle. However in this example, the change speed gearbox 41' is arranged rearwardly of the vehicle, closer to the rear axle 31' than the gearbox 41' of the vehicle of FIG. 10. Thus input shaft 88' of the gearbox 41' extends forwardly of the vehicle rather rearwardly as is the case with the arrangements shown in FIGS. 9 and 10. The output shaft 87' of the transfer mechanism 82' thus extends rearwardly of the vehicle. In the FIG. 11 arrangement, the cooling radiator indicated at 90' is located rearwardly of engine 71' rather than forwardly of the engine 71' as in the arrangements of FIGS. 9 and 10. The engine mountings are shown at 76', the gear box mounting at 76*a*', being provided on a bracket on the frame member 14' and the transfer box mounting at 77' being provided on the mounting frame 74'.

Figure 12:
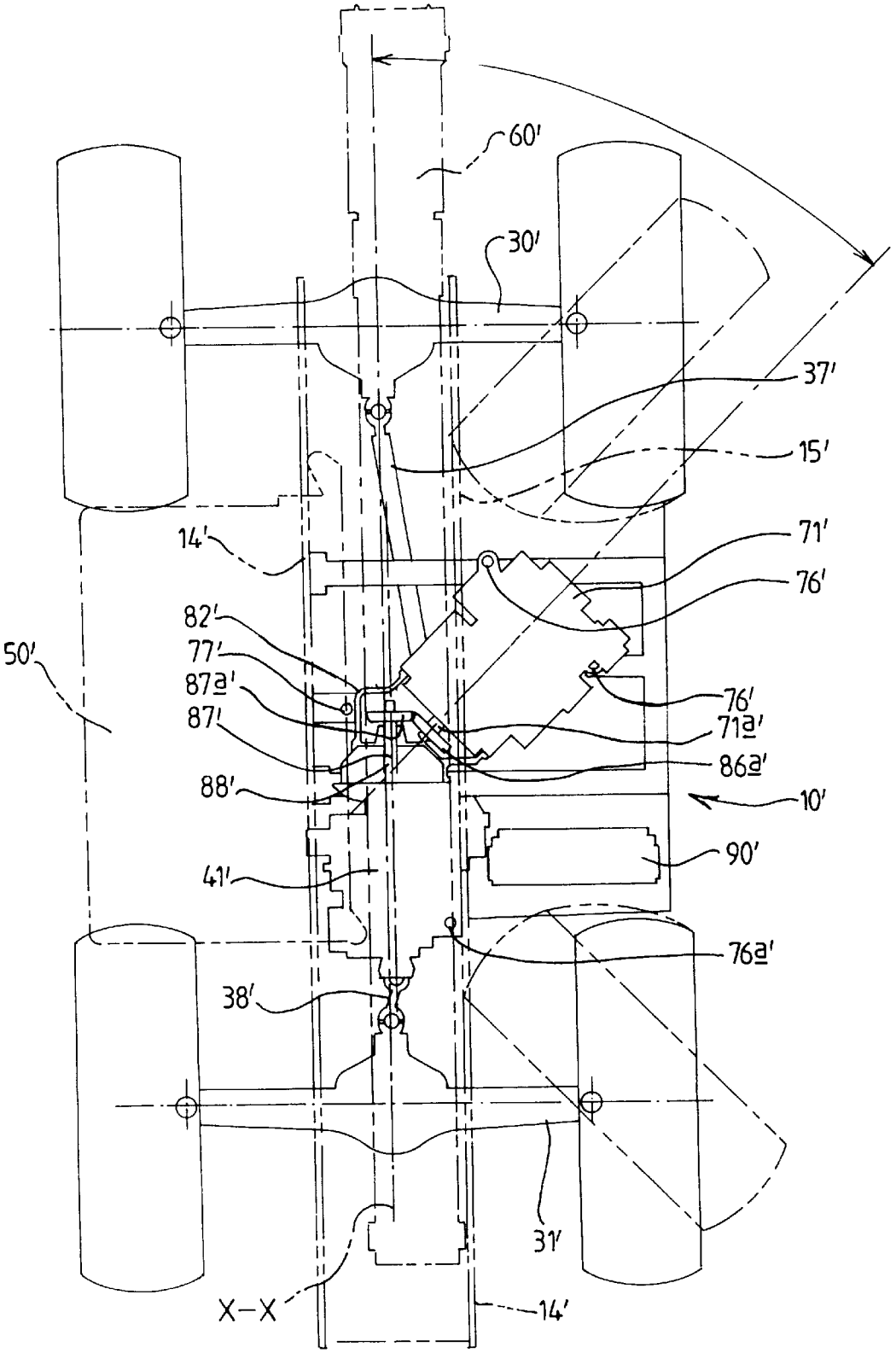
FIG. 12 is a plan view, with parts omitted for clarity, of another alternative vehicle embodying the invention.

The vehicle of FIG. 12 is again generally identical to the vehicles of FIGS. 9, 10 and 11 and corresponding parts are again labelled with the same reference numerals. In FIG. 12, the engine 71' is so arranged that its output shaft 71*a*' extends at 45° to the longitudinal axis X-X of the vehicle 10' towards the rear axle 31' of the vehicle, as with the arrangement of FIG. 9. However, like with the arrangement of FIG. 11, the change speed gearbox 41' is arranged towards the rear axle 31'. Thus the input shaft 88' to the change speed gearbox 41' extends forwardly towards the front axle 30' of the vehicle 10' with corresponding changes to the configuration of the transfer box 82'. The engine mountings are shown at 76', the gear box mounting at 76*a*', being provided on a bracket on the frame member 14' and the transfer box mounting at 77' being provided on a bracket on the frame member 15'.

Of course, although in the arrangements of FIGS. 9 to 12, the output shaft 71*c*' of the engine 71' has in each case extended generally at 45° to the longitudinal axis X-X of the vehicle, in another arrangement, the respective shaft 71*c*' could extend transversely at other than 45° such as within the range 35°–55°, or at any other desired angle, with suitable changes to the configuration of the transfer box 82' and the positionings of the respective engine mountings 76'.

Figure 13:
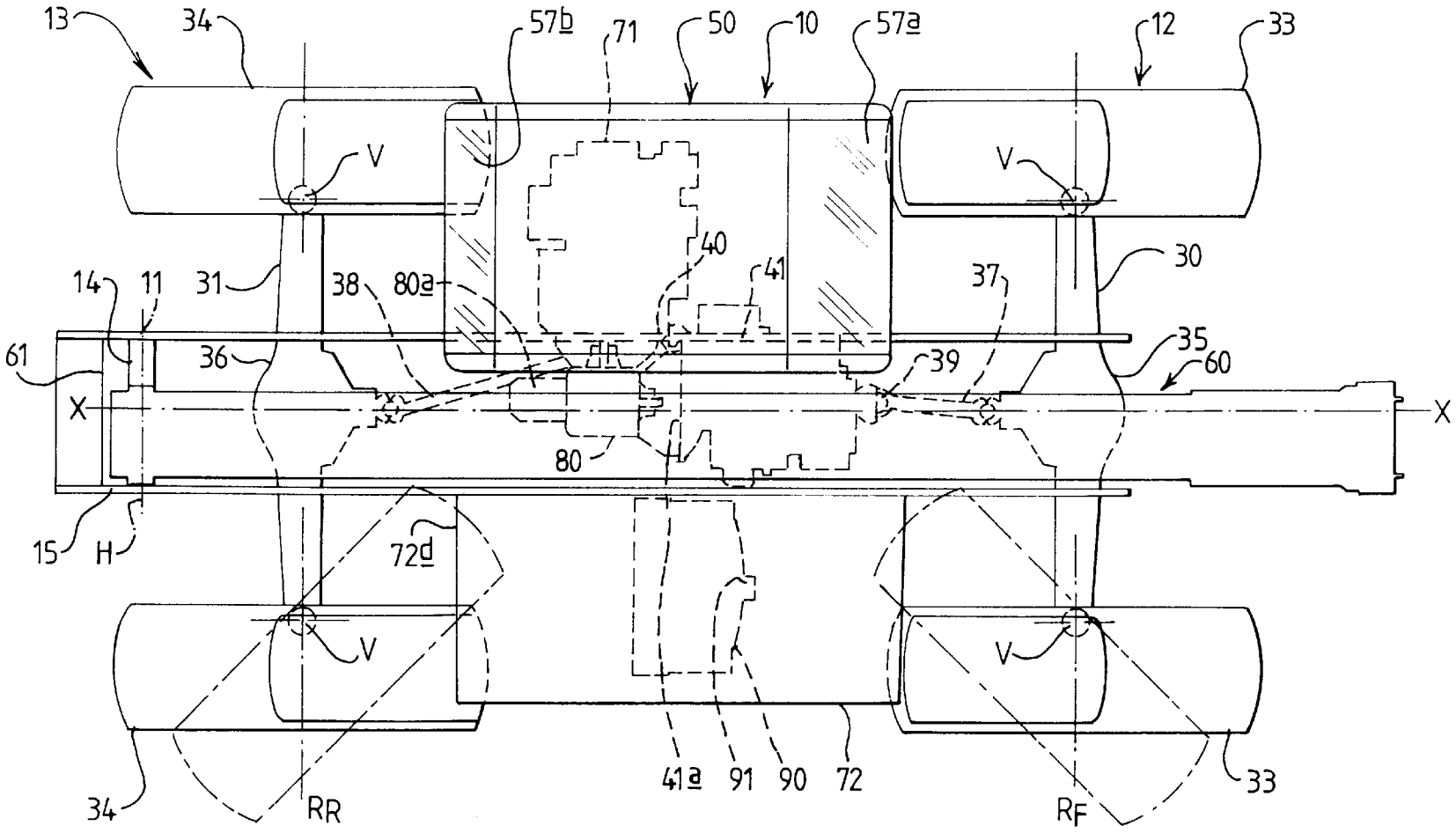
FIG. 13 is a plan view of another alternative vehicle embodying the invention.
Figure 14:
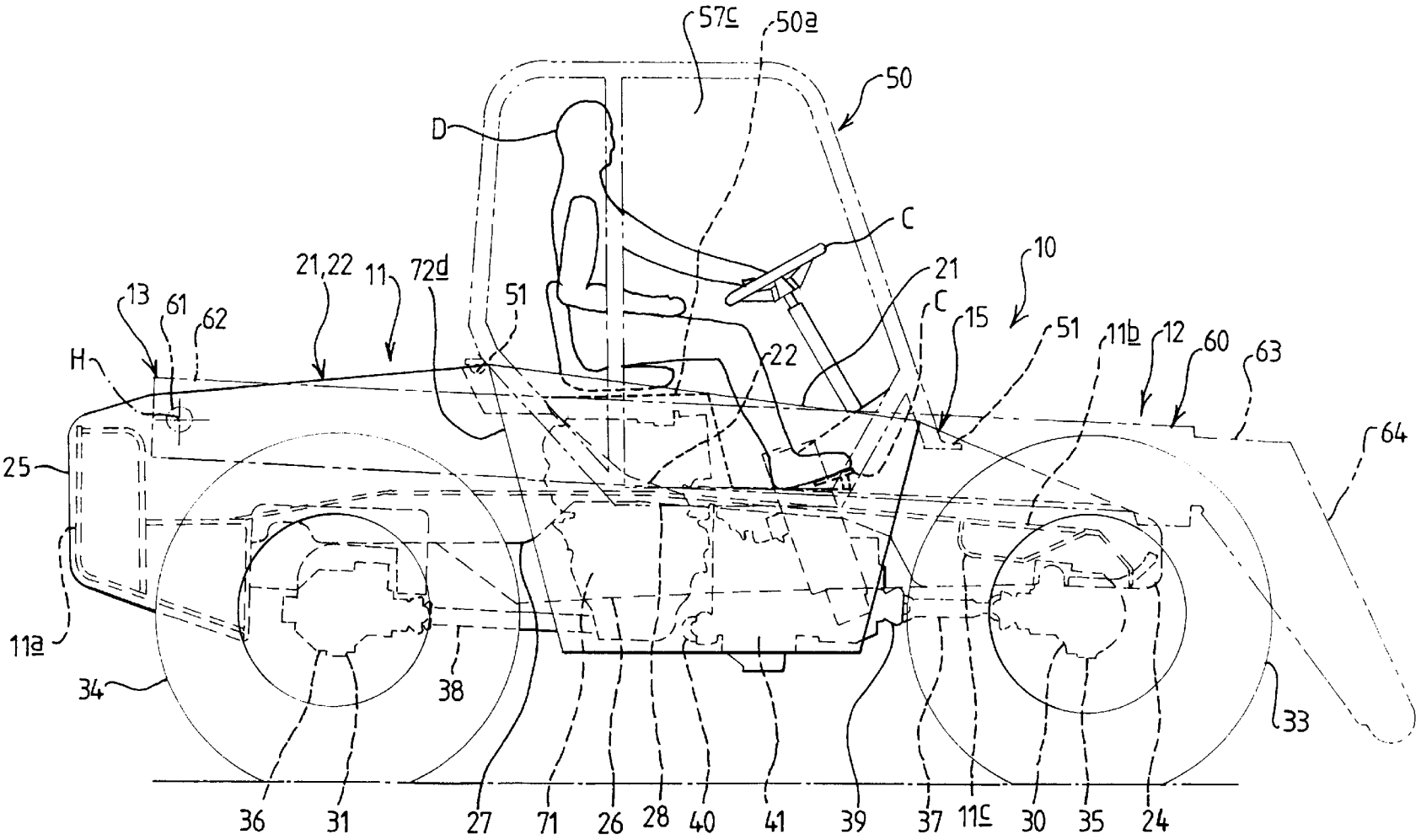
FIG. 14 is a side elevation of the material handling vehicle shown in FIG. 13.

FIGS. 13 and 14 show diagrammatically a modification of the vehicle shown in FIGS. 1 to 4. The vehicle of FIGS. 13 and 14 is similar to that in FIGS. 1 to 4 and hence the same reference numerals have been used for FIGS. 13 and 14 as were used with reference to FIGS. 1 to 4 to refer to corresponding parts.

The vehicle of FIGS. 13 and 14 differs from that of FIGS. 1 to 4 only in that the engine 71 is, in this embodiment, disposed on the same side of the longitudinal axis X-X of the vehicle as the cab 50 and is disposed beneath the cab 50. That is to say, beneath a bottom wall part 50*a* of the cab 50 which separates the interior of the cab 50 which contains the driver D and controls C from the exterior below the driver D and controls C. As shown, the bottom wall part 50*a* is not rectilinear and includes upwardly extending portions which extend between parts of the wall 50*a* which are at different levels. Although as illustrated, these upwardly extending portions are inclined from the horizontal and the vertical, if desired they may, of course, extend vertically and still be regarded as part of the floor of the cab.

The cooling radiator 90 is, in this embodiment, disposed on the opposite side of the longitudinal axis X-X of the vehicle to the cab and is disposed in a housing 72 which is similar in configuration to the housing 72 of the embodiment of FIGS. 1 to 4. If desired, the radiator may be positioned at other location of the vehicle and the housing 72 may be absent or its configuration suitably modified. Where a housing the same as or similar to the housing 72, or indeed any other housing, is provided for the cooling radiator, or for any other component of the machine, between the front and rear wheels 33, 34 on the opposite side of the axis X-X to the cab 50, then a well similar to the well described hereinbefore is provided.

The radiator 90 is supplied with a coolant of the engine 71 via pipes, not shown, and as in the previously described embodiment the radiator may be provided with a hydraulically operated fan or an electrically operated fan.

The gearbox 41 of the present embodiment is the same as the gearbox 41 of the embodiment of FIGS. 1 to 4, as is its driving connection to the wheels 34, 33. The transfer mechanism 80 is the same as the transfer mechanism described with reference to FIGS. 1 to 4 but is, of course, orientated at 180° to the orientation described with reference to FIGS. 1 to 4.

In all other respects the embodiment is as described with reference to FIGS. 1 to 4.

The modifications of the embodiment shown in FIGS. 1 to 4 described with reference to FIGS. 5 to 8 may be applied, mutatis mutandis, to the embodiment of FIGS. 13 and 14.

The modifications shown in FIGS. 9 to 12 may also, in principle, be applied to the embodiment of FIGS. 13 and 14 particularly, for example, the embodiment of FIG. 10, where the engine would be disposed substantially in a rear part of the cab, but the embodiments shown in, for example, FIG. 9 or FIG. 12 would necessitate repositioning the driver in the cab so that the floor of the cab may provide space therebeneath for an engine disposed in the configuration analogous to that shown in these Figures.

If desired in any embodiment based on that of FIGS. 13 and 14, a part of the engine may be disposed outwardly of the plan outline of the cab. For example, a part of the fly wheel housing of the engine may be disposed outwardly of said plan outline of the cab towards the loader arm for connection to the transfer mechanism 80.

If desired, in any embodiment the wheels on the front axle may have a different track to the wheels of the rear axle, whilst the wheels of an axle are equivalent from, and on opposite sides of, the longitudinal axis of the vehicle.

If desired the ground engageable propulsion means may comprise endless tracks.

The features disclosed in the foregoing description, or the following claims, or the accompanying drawings, expressed in their specific forms or in terms of a means for performing the disclosed function, or a method or process for attaining the disclosed result, or a class or group of substances or compositions, as appropriate, may, separately or in any combination of such features, be utilised for realisilg the invention in diverse forms thereof.

We claim:

1. A material-handling vehicle comprising a structure having ground engageable propulsion means, a loader arm, having a longitudinal axis, mounted at the rear of the structure for up and down swinging movement, an operator's cab, an engine to provide power for said swinging movement of the arm and propulsion of the vehicle, the engine having an output shaft, wherein the ground engageable propulsion means is driven by the engine via a mechanical transmission coupled to said output shaft, the engine and the mechanical transmission being rigidly connected and the mechanical transmission being mounted on the structure by mounting means and the engine being supported in cantilever on the mechanical transmission.

2. A vehicle according to claim 1 wherein the mechanical transmission includes a gearbox.

3. A vehicle according to claim 2 wherein the engine is transversely disposed with its output shaft transverse to the vehicle and the vehicle has a transfer mechanism to transfer drive from the transversely extending output shaft of the engine to the gearbox.

4. A vehicle according to claim 3 wherein the engine, transfer mechanism and gearbox are rigidly connected together.

5. A vehicle according to claim 4 wherein the gearbox has a mounting on the side of the gearbox which is on the opposite side of the fore and aft axis of the vehicle to the engine.

6. A vehicle according to claim 5 wherein the structure includes spaced fore-and-aft extending frame members, the housing of the transfer mechanism has a first and a second mounting means disposed on opposite sides of the axis of rotation of the output shaft of the engine, said first and second mounting means are carried by one of fore-and-aft extending frame members, and the mounting of the gearbox is carried by the other of the fore and aft extending frame members.

7. A vehicle according to claim 4 wherein the transfer mechanism comprises a housing having a first mounting face, which faces transversely outwardly of the vehicle, to which a mounting face of the engine is connected, and a second mounting face facing in the fore and aft direction of the vehicle, to which a mounting face of the gearbox is connected.

8. A vehicle according to claim 3 wherein the transfer mechanism is provided with damping means between the engine output shaft and the transfer mechanism input shaft to reduce engine induced vibrations or resonance.

9. A vehicle according to claim 3 wherein the housing of the transfer mechanism has a first and a second mounting means disposed on opposite sides of the axis of rotation of the output shaft of the engine.

10. A vehicle according to claim 9 wherein the structure includes spaced fore-and-aft extending frame members and said first and second mounting means are carried by one of the fore and aft extending frame members.

11. A vehicle according to claim 3 wherein the transfer mechanism comprises an input shaft and an output shaft disposed at an angle to each other, the transfer mechanism input shaft being connected to the output shaft of the engine and the transfer mechanism output shaft being connected to the input shaft to the gearbox and the input and output shafts of the transfer mechanism being connectable in torque transmitting relationship.

12. A vehicle according to claim 11 wherein the input and output shafts are connectable in said torque transmitting relationship by a bevel gear set.

13. A vehicle according to claim 11 wherein the output shaft of the engine is inclined to the longitudinal axis of the vehicle and the input shaft of the transfer mechanism is inclined to the output shaft of the transfer mechanism at a corresponding angle.

14. A vehicle according to claim 11 wherein the output shaft of the engine lies at 90° to the longitudinal axis of the vehicle and the input shaft of the transfer mechanism is arranged at 90° to the output shaft of the transfer mechanism.

15. A vehicle according to claim 11 wherein the output shaft of the engine lies at 45° to the longitudinal axis of the vehicle and the input shaft of the transfer mechanism is arranged at 45° to the output shaft of the transfer mechanism.

16. A vehicle according to claim 2 wherein a well is provided, between the cab and one of the engine and a housing disposed on the opposite side of the loader arm's longitudinal axis to the cab, wherein the arm in a lowered position can be at least partly accommodated, and wherein the gearbox is disposed underneath the well.

17. A vehicle according to claim 16 wherein the gearbox has an input shaft which extends generally parallel to the longitudinal axis of the vehicle and at least one output shaft which also extends generally parallel to the longitudinal axis of the vehicle and there being a transfer mechanism having an input shaft to transfer the drive from the transversely extending output shaft of the engine to the longitudinally extending input shaft to the gearbox.

18. A vehicle according to claim 2 wherein the gearbox has an input shaft which extends generally parallel to the longitudinal axis of the vehicle and at least one output shaft which also extends generally parallel to the longitudinal axis of the vehicle.

19. A vehicle according to claim 1 wherein the loader arm extends forwardly parallel to a vertical plane containing a longitudinal axis of the vehicle.

20. A vehicle according to claim 19 wherein the output shaft of the engine is transversely perpendicular to the longitudinal axis of the vehicle.

21. A vehicle according to claim 19 wherein the output shaft of the engine is transversely arranged at an angle other than perpendicular to the longitudinal axis of the vehicle.

22. A vehicle according to claim 21 wherein the output shaft is at an angle in the range 35°–55° to the longitudinal axis of the vehicle.

23. A vehicle according to claim 11 wherein the engine is located on the same side of the loader arm to the cab with the engine disposed at least partly beneath the cab.

24. A vehicle according to claim 23 wherein a housing is provided, disposed on the opposite side of the loader arm to the cab, and a well is provided, between the cab and the housing, in which the arm, in a lowered position, can be at least partly accommodated.

25. A vehicle according to claim 24 wherein the housing houses a cooling means for the engine or a fuel or an oil tank.

26. A vehicle according to claim 1 wherein the loader arm is mounted on the structure at a position which is not more than a predetermined distance above a horizontal plane passing through the highest part of the engine or the engine.

27. A vehicle according to claim 26 wherein the loader arm, at the position alongside the highest point of the engine, is not more than a second predetermined distance above said horizontal plane.

28. A vehicle according to claim 1 wherein the ground engageable propulsion means comprise a pair of ground engageable wheels disposed adjacent the front of the structure and a pair of rear ground engageable wheels adjacent the rear of the structure.

29. A vehicle according to claim 28 wherein the mechanical transmission comprises a gearbox, and wherein the wheels of the front pair are driven from a first output shaft of the gearbox while the wheels of the rear pair are driven by a second output shaft of the gearbox through differential gear means.

30. A vehicle according to claim 1 wherein the engine is located on the opposite side of the loader arm longitudinal axis to the cab and the engine is spaced from the cab to define a well between the cab and the engine in which the arm, in a lowered position, can be at least partly accommodated.

31. A vehicle according to claim 30 wherein the engine is disposed in a housing.

32. A material-handling vehicle according to claim 1 wherein said operator's cab is disposed on the structure on a side of the loader arm longitudinal axis and the engine is located on a side of the loader arm longitudinal axis and the engine is transversely disposed with its output shaft transverse to the vehicle.

33. A vehicle according to claim 1 wherein the engine is disposed on the opposite side of the loader arm longitudinal axis to the cab.

34. A vehicle according to claim 11 wherein the engine is a reciprocatory piston engine and the output shaft is provided by the crankshaft of the engine.

35. A vehicle according to claim 11 wherein the structure has a front end and a rear end with said longitudinal axis of the vehicle extending therebetween and the ground engageable propulsion means being disposed equi-distant from, and on opposite sides of, said longitudinal axis.

36. A vehicle according to claim 1 wherein the loader arm carries a material handling implement at its front end so that the material handling implement is disposed in front of the front of the structure when the arm is in its lowermost position.

37. A vehicle according to claim 1 wherein the cab has a side window which faces transversely across the vehicle at right angles to the longitudinal axis of the vehicle.

38. A vehicle according to claim 1 wherein the structure comprises a pair of spaced fore and aft extending frame members.

39. A vehicle according to claim 1 wherein the vehicle is provided with mounting means to accommodate torsional movement and lateral, axial, and vertical movement of both engine and the mechanical transmission.

40. A vehicle according to claim 1 wherein the mounting means are vibration isolating mountings.

41. A vehicle according to claim 1 wherein the transmission has a first and a second mounting means disposed on opposite sides of the axis of rotation of the output shaft of the engine.

42. A material-handling vehicle comprising a structure having ground engageable propulsion means, a loader arm, having a longitudinal axis, mounted at the rear of the structure for up and down swinging movement, an operator's cab disposed on the structure on a side of the loader arm longitudinal axis and an engine mounted on the structure to provide power for said swinging movement of the arm and propulsion of the vehicle, wherein the engine is located on a side of the loader arm longitudinal axis and the engine has an output shaft and the engine is transversely disposed with its output shaft transverse to the vehicle, the ground engageable propulsion means is driven via a mechanical transmission comprising a gear box having an input shaft which extends parallel to the longitudinal axis of the vehicle and at least one output shaft which also extends generally parallel to the longitudinal axis of the vehicle and there being a transfer mechanism having an input shaft and an output shaft to transfer drive from the transversely extending output shaft of the engine to the longitudinally extending input shaft to the gear box, the engine, transfer mechanism and gear box being rigidly connected together, wherein the housing of the transfer mechanism and the gear box are mounted on said structure by mounting means, and support means for supporting said engine from said housing of the transfer mechanism.

* * * * *